US005620537A

United States Patent [19]

Bampton

[11] Patent Number: 5,620,537

[45] Date of Patent: Apr. 15, 1997

[54] METHOD OF SUPERPLASTIC EXTRUSION

[75] Inventor: Clifford C. Bampton, Thousand Oaks, Calif.

[73] Assignee: Rockwell International Corporation, Thousand Oaks, Calif.

[21] Appl. No.: 431,186

[22] Filed: Apr. 28, 1995

[51] Int. Cl.[6] ..... C22F 1/04

[52] U.S. Cl. ..... 148/564; 148/689; 148/690; 420/902

[58] Field of Search ..... 148/564, 689, 148/690, 695; 420/902

[56] References Cited

U.S. PATENT DOCUMENTS

| | | | |
|---|---|---|---|
| 3,975,219 | 8/1976 | Allen et al. | 148/404 |
| 4,721,537 | 1/1988 | Ghosh | 148/12.7 A |
| 5,078,806 | 1/1992 | Das et al. | 148/406 |
| 5,400,633 | 3/1995 | Segal | 72/272 |

FOREIGN PATENT DOCUMENTS

| | | |
|---|---|---|
| 0508858A1 | 10/1992 | European Pat. Off. . |
| 2236613 | 2/1975 | France . |
| 59-038367 | 3/1984 | Japan . |
| 1693114 | 11/1991 | U.S.S.R. . |

OTHER PUBLICATIONS

Segal et al., "The Application of Equal Channel Angular Extrusion to Produce Extraordinary Properties in Advanced Metallic Materials," *First International Conference on Processing Materials for Properties* (H. Henein and T. Oki, Editors), pp. 971–974, The Minerals, Metals & Materials Society, 1993.

*Primary Examiner*—George Wyszomierski

[57] ABSTRACT

A method of superplastic extrusion is provided for fabricating large, complex-shaped, high strength metal alloy components, such as large, thin cross section, closed-box panels or integrally "T-stiffened" aircraft skin panels. Superplastic extrusion is similar to conventional extrusion except that strain rate and temperature are carefully controlled to keep an ultra-fine grain high strength metal alloy within the superplastic regime where deformation occurs through grain boundary sliding. A high strength, heat treatable metal alloy is first processed, such as by equal channel angular extrusion (ECAE), to have a uniform, equiaxed, ultra-fine grain size in thick section billet form. Temperature and strain rate are controlled during superplastic extrusion of the ultra-fine grained billet so that the stresses required for metal flow are much lower than those needed in conventional extrusion. The low stresses allow use of more fragile extrusion dies, including multi-hale dies for hollow core extrusions, thereby achieving thinner section details in larger extruded components for a given press loading capacity. After superplastic extrusion, components may be solution treated, stretch straightened, and creep-age formed in an autoclave, as required. The resulting large, compound curvature, thin section, integrally stiffened, high strength metal alloy components retain a uniform, equiaxed, fine grain size, which imparts superior strength, isotropy, ductility, toughness, and corrosion resistance compared with conventional grain sized metal alloys.

14 Claims, 2 Drawing Sheets

METHOD OF SUPERPLASTIC EXTRUSION

TECHNICAL FIELD

The present invention relates to superplastic forming of metal alloys and, in particular, to a process of superplastic extrusion.

BACKGROUND OF THE INVENTION

Structures fabricated from high strength metal alloys generally comprise mechanically fastened assemblies that are built up from individual sheets, plates, and forged components. This type of construction of built-up assemblies, however, severely limits savings that can be obtained in structural weights and manufacturing costs.

A primary way to decrease costs of high strength metal assemblies is to design structures that can be fabricated using integral construction techniques. One such method of integral construction is the well-known process of extrusion. Extrusion, however, has not been a useful process for large, high strength, metal alloy components because of limitations on part complexity, minimum detail thickness, press size, and local microstructure control of the metal alloy.

Because of the potential for weight reductions and cost savings in high strength metal alloy components, particularly in the aerospace industry, there is a need for improved processes for integral construction of high strength metal alloys.

SUMMARY OF THE INVENTION

The present invention comprises a method of superplastic extrusion that is useful for fabricating large, complex-shaped, high strength metal alloy components, such as those used in the aircraft industry. Superplastic extrusion is similar to conventional extrusion processes except that strain rate and temperature are carefully controlled to keep the metal alloy within the superplastic regime during the process. With typical coarse grain or unrecrystallized metal alloys, superplastic extrusion is not practicable. However, the strain rate and temperature conditions required for superplastic extrusion can be maintained for metal alloys that have ultra-fine grain sizes (i.e., grain dimensions less than about 10 μm, including submicron). Such alloy systems include aluminum alloys; titanium alloys; nickel, cobalt, and iron-based superalloys; stainless steels; carbon steels; copper alloys; magnesium alloys; and other superplastically formable alloys.

A high strength, heat treatable metal alloy, such as the widely used AA7475 (Aluminum Association designation) aluminum alloy or the more recently developed AA2090 aluminum alloy, for example, is first processed to have a uniform, equiaxed, ultra-fine grain size. This may be achieved while the alloy is still in a thick section form, such as a 1 inch thick plate, by a prior art process known as equal channel angular extrusion (ECAE), for example. Such an alloy billet with ultra-fine grain size is suitable for superplastic extrusion (SPE).

During superplastic extrusion of the ultra-fine grained billet, temperature and strain rate are controlled so that the stresses necessary for metal flow are much lower than those required in conventional extrusion. The low deformation stresses allow more fragile extrusion dies to be used, thereby achieving thinner section details in the extruded component and larger overall extruded panels for a given press loading capacity. Thus, the superplastic extrusion process is useful for producing very large, very thin cross section panels, such as hollow core closed-box panels or integrally "T-stiffened" aircraft skin panels, for example.

After superplastic extrusion, integrally stiffened panels can be solution treated and stretch straightened. Stretch straightening removes distortions that may have occurred while the panels exited the extrusion die or during water quenching in the subsequent solution treatment. It also provides the small amount of deformation energy to allow the higher strength T8 temper (rather than the alternate T6 temper), which benefits some high strength alloys such as AA2090 aluminum alloy, for example. Although extruded panels may have inherent curvature only transverse to the extrusion axis and integral stiffening features that prohibit conventional forming of curvature in the orthogonal direction, the panels may be creep-age formed in an autoclave to achieve compound curvatures. Although an ultra-fine grain size provides exceptionally high strength at ambient temperatures, significant grain boundary sliding may occur at only moderately elevated temperatures, which results in high creep rates or superplasticity, depending on the actual temperature and applied deformation stresses. Thus, a simple vacuum sealing procedure on an extruded panel in an autoclave capable of applying gas pressures of a few hundred psi and temperatures typically in the range of 250°–300° F. may simultaneously heat treat age the alloy to the T8 temper and creep form a compound curvature over the panel. The resulting large, compound curvature, thin section, integrally stiffened, high strength metal alloy panels may retain an ultra-fine grain size, which imparts superior strength, ductility, toughness, and corrosion resistance compared with conventional grain sized metal alloys. Even if significant grain growth occurs during solution heat treatment, however, the uniformity and equiaxed nature of the fully recrystallized grain structure ensures uniform and isotropic mechanical properties generally not found in conventionally extruded high strength alloys.

A principal object of the invention is integral construction of high strength metal alloy components. A feature of the invention is a process of superplastic extrusion. An advantage of the invention is production of large, integrally constructed, complex-shaped, lightweight, low cost, durable, and repairable high strength metal alloy components having uniform and isotropic mechanical and corrosion resistant properties.

BRIEF DESCRIPTION OF THE DRAWINGS

For a more complete understanding of the present invention and for further advantages thereof, the following Detailed Description of the Preferred Embodiments makes reference to the accompanying Drawings, in which.

DETAILED DESCRIPTION OF THE PREFERRED EMBODIMENTS

Figure 1:
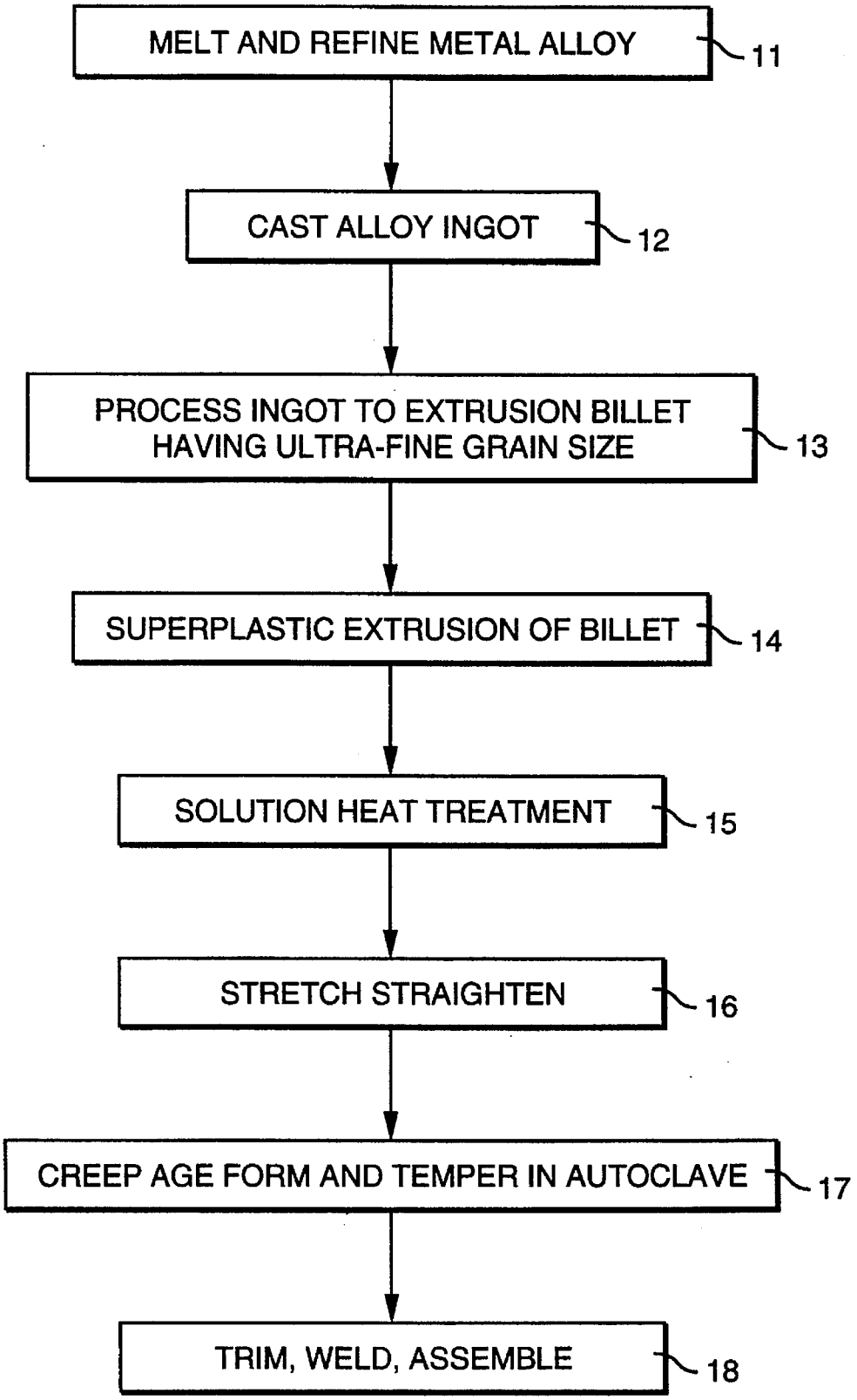
FIG. 1 is a flow diagram indicating the steps in forming an integrally constructed metal component using a superplastic extrusion process of the present invention.

The present invention comprises a method of superplastic extrusion. The method may be combined synergistically with other advanced metal forming processes to produce integrally constructed, complex-shaped, monolithic components in high strength metal alloys at lower cost and lighter weight than equivalent conventional built-up assemblies. FIG. 1 outlines some of the metal forming techniques that may be used to produce integrally constructed metal components in conjunction with the process of superplastic extrusion.

Referring to FIG. 1, the first step 11 is to melt and refine the metal alloy. Alloy systems suitable for the process of superplastic extrusion include aluminum alloys; titanium alloys; nickel, cobalt, and iron-based superalloys; stainless steels; carbon steels; copper alloys; magnesium alloys; and other superplastically formable alloys. After the alloy has been refined, it may be cast into an ingot as indicated at step 12.

Figure 2:
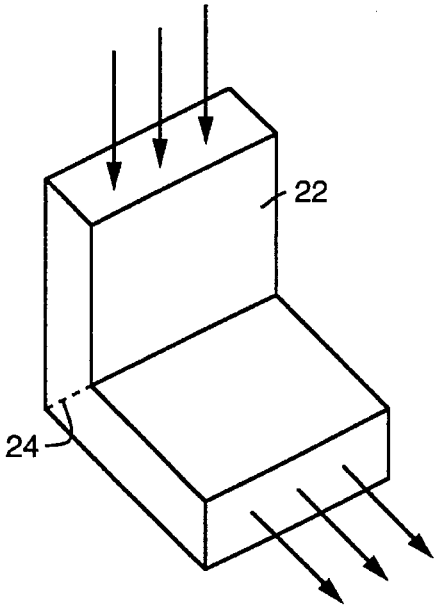
Figure 2 Prior Art
FIG. 2 is a schematic diagram of the prior art process of equal channel angular extrusion (ECAE) for producing a metal billet having ultra-fine grain size.

In preparation for superplastic extrusion, it is necessary to process the ingot cast at step 13 into an extrusion billet having a uniform, equiaxed, ultra-fine grain microstructure (i.e., grain dimensions less than about 10 μm, including submicron size). Prior art processes such as equal channel angular extrusion (ECAE), powder metallurgy, and multi-step, multi-axis isothermal, controlled strain rate forging can produce a uniform, equiaxed, ultra-fine grain size microstructure in metal alloys. The ECAE process, which can produce an ultra-fine grain size in thick section billets, such as 1 inch thick plate, for example, is described in Segal et al., "The Application of Equal Channel Angular Extrusion to Produce Extraordinary Properties in Advanced Metallic Materials," First Int. Conf. on Proc. Mat. for Prop., Henein et al., Eds., pp. 971–74, Honolulu, Hi., (1993). In the ECAE process, as illustrated schematically in FIG. 2, a billet 22 is extruded through perpendicular channels with equal cross section. The ECAE process generates uniform shear deformation across the billet, as indicated by the dotted line 24. High levels of cumulative deformation can be produced in the bulk material, without changing the external dimensions of the billet 22, by multiple passes of billet 22 through an ECAE die under low pressure. This capability of ECAE to impart very high cumulative deformation allows exceptional control of microstructure, including uniform, equiaxed, ultra-fine grain size, throughout thick section billets. Other known methods, such as the "Method of Producing a Fine Grain Aluminum Alloy using Three Axes Deformation" described in U.S. Pat. No. 4,721,537 issued to Ghosh, have proven difficult to scale up to large size billets.

Such methods generally achieve controlled microstructures only in specially processed thin sheets or by using rapidly solidified powder processes.

Superplastic Extrusion (SPE)

The present invention of superplastic extrusion (SPE), indicated at step 14 in FIG. 1, is practical only if the starting metal alloy billet has a uniform, equiaxed, ultra-fine grain size, which can be produced by the processes described above. A fine grain size is necessary to achieve the superplastic deformation mechanism of grain boundary sliding. Alloys with conventional, coarse, non-equiaxed, or unrecrystallized grain structures deform effectively only by crystallographic dislocation mechanisms rather than superplastic mechanisms.

Figure 3:
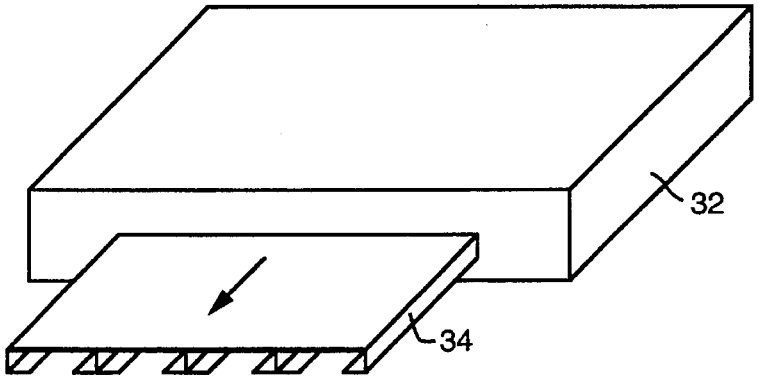
FIG. 3 is a simplified perspective view of an isothermal extrusion die producing an integrally constructed metal component by superplastic extrusion.

Conventional extrusion of metal components is performed at the highest possible strain rates using preheated billets and non-isothermal dies. Superplastic extrusion, illustrated schematically in FIG. 3, is similar to conventional metal extrusion through a die except that the strain rate and temperature of the metal alloy billet are controlled to maintain the alloy within its superplastic regime during extrusion. The superplastic temperature regime for a particular alloy is bounded at the high end by the temperature at which significant grain growth occurs and at the low end by the temperature at which superplasticity begins. In general, superplasticity occurs at lower temperatures for finer-grained materials. As the grain size increases, the temperature for superplasticity increases so that the temperature range available for superplastic forming decreases, generally to the point where superplasticity no longer exists.

Figure 4:
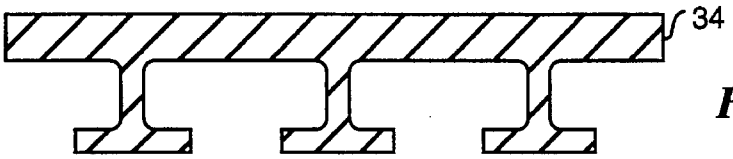
FIG. 4 is a schematic cross section of a segment of a "T-stiffened" metal panel produced by the superplastic extrusion process of the present invention.
Figure 5:
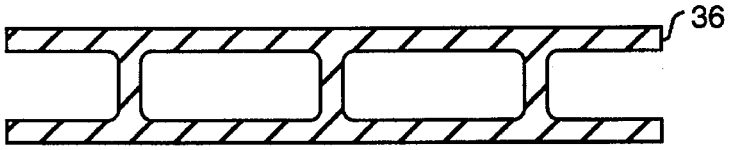
FIG. 5 is a schematic cross section of a segment of a closed-box metal panel produced by the superplastic extrusion process of the present invention.

Metal alloy flow stresses from grain boundary sliding during the ultra-fine grain SPE process using temperature controlled dies, such as isothermal die 32 that is thermostatically controlled for maintaining temperature within the superplastic regime, are typically more than an order of magnitude lower than those generated from dislocation deformation that occurs during conventional extrusion. The low flow stresses that occur during superplastic extrusion allow more fragile extrusion dies 32 to be used, which in turn allow thinner section details in the extrusion 34, and larger overall panels for a given press loading capacity. The SPE process may be used to produce very large, very thin cross section panels, such as T-stiffened panel 34 or closed-box panel 36, for example, by maintaining the strain rate within the superplastic regime at the fastest straining locations in the particular extrusion die. Cross sections of segments of T-stiffened extruded panel 34 and closed-box extruded panel 36 are illustrated in FIGS. 4 and 5, respectively, as examples of complex-shaped extruded components. The final microstructure of superplastically extruded components retains the uniform, equiaxed, fine grain structure that provides superior and more isotropic properties compared with conventionally extruded products.

A major advantage of the superplastic extrusion process of the present invention is the capability of extruding hollow section components, such closed-box panel 36 for example, in high strength alloys. The simplest form of hollow section component is a circular tube, but many more complex variations have been successfully extruded. Special multi-hole dies, which require higher extrusion pressures, can be used with alloys that can be welded under pressure. Multi-hole dies have openings in the top face of the die from which material is extruded into two or more segments and then, beneath the surface of the die, welded (generally by diffusion bonding) and forced through a final shape die configuration to form the hollow section component. The tubular portion of the extruded shape is formed by a mandrel attached to the lower side of the top die segment. This provides a fixed support for the mandrel and a continuous hole in the extrusion. The material must shear in order to flow through the various segments of the die and form a sound weld before final extrusion.

Conventional extrusion through multi-hole dies (i.e., with fast strain rate, non-isothermal dies, and large grain size metals) is limited to very low shear strength alloys, such as soft aluminum alloys. Harder alloy systems, such as high strength aluminum, copper, and steels alloys, for example, generally cannot be extruded using multi-hole dies because of their high shear strengths at extrusion temperatures. In the superplastic extrusion process, however, the shear strength of ultra-fine grained materials is reduced by roughly a factor of ten, allowing extrusion through multi-hole dies. In addition, the ultra-fine grain size greatly facilitates the solid state welding (e.g., diffusion bonding) which is a necessary part of the hollow section, multi-hole die extrusion process.

SPE Process Examples

Superplastic extrusion of AA2090 (Aluminum Association designation) aluminum-lithium alloy samples is described as an example, not a limitation, of the process of the present invention. Constant true strain rate tensile tests of the AA2090 alloy, which had been processed by ECAE to an ultra-fine grain size, exhibited a maximum in superplastic behavior at a temperature of about 660° F. and a true strain rate of about $10^{-4}sec^{-1}$. For test purposes, a simple extrusion die was fabricated with an extrusion ratio of 15:1 to demonstrate the superplastic extrusion process at the foregoing temperature and strain rate. I-beam shaped extrusions were formed in a press with controls to maintain a constant displacement rate and a constant die temperature. The time average mean strain rate, $\epsilon_t$, is calculated as follows:

$$\epsilon_t = 6v \ln R/D_b$$

where v is the displacement rate (i.e., extrusion ram speed), R is the extrusion ratio, and $D_b$ is the billet diameter. Superplastic extrusion of an ultra-fine grain AA2090 alloy sample at an extrusion ratio of 15:1 was successful at very low pressures (about 300 psi in the body of the extrusion billet) at 635° F. and a ram speed of 0.0001 inch/second. The center and lower webs of the I-beam shaped superplastic extrusion were 0.020 inch (0.5 mm) thick with a good surface finish. Attempts to extrude this configuration conventionally with a standard AA2090 alloy would require pressures more than 10 times greater and would result in failure of the extrusion die.

As stated above, the process of superplastic extrusion is suitable for alloy systems including aluminum alloys; titanium alloys; nickel, cobalt, and iron-based superalloys; stainless steels; carbon steels; copper alloys; magnesium alloys; and other superplastically formable alloys. By way of example, and not limitation, the approximate superplastic extrusion temperatures and strain rates for various ultra-fine grain processed alloy billets are set forth in Table 1.

TABLE 1

Superplastic Regimes for Example Alloys

| Alloy Composition (Ultra-Fine Grain) | SPE Temp. (°F.) | SPE Strain Rate ($\times 10^{-4}s^{-1}$) |
|---|---|---|
| Ti - 6.5% Al, 3.2% Mo, 0.3% Si | 1200 | 7 |
| Al - 4% Cu, 0.5% Zr | 430 | 3 |
| Mg - 1.5% Mn, 0.3% Ge | 320 | 7 |
| Al - 6% Zn, 3% Mg, 1.5% Cu, 0.2% Cr | 660 | 10 |
| Cu - 3% Ag, 0.35% Zr | 840 | 2 |
| Ni - 14% Cr, 3% Mo, 1.5% Al, 2.5% Ti, 2.6% Fe, 2.1% Nb | 1760 | 5 |
| Al - 2.7% Cu, 2.2% Li, 0.25% Mg, 0.12% Zr | 660 | 1 |

Heat Treatment and Creep Forming for Compound Curvatures

After superplastic extrusion, components such as integrally stiffened panel 34 may be solution treated, as indicated in FIG. 1 at step 15, and stretch straightened, as indicated at step 16. Additional processing may include simultaneous aging and creep forming in an autoclave, as indicated at step 17. High creep rates under low stresses can be achieved at only moderately elevated temperatures because the ultra-fine grain microstructure of superplastically extruded components allows significant grain boundary sliding. However, the ultra-fine grain size microstructure also provides exceptionally high strength at ambient temperatures. Because of these characteristics, simple vacuum sealing of an extruded component (e.g., in an autoclave capable of applying gas pressures of a few hundred psi and temperatures in the range of 250°–300° F. for high strength AA2090 aluminum alloy, for example) can simultaneously heat treat age the alloy to a required condition, such as, high strength T8 temper, and creep form a compound curvature using a mold, such as the surface of a simple metal or ceramic tool having the desired curvature. Close dimensional tolerances and high repeatability are inherent in the creep age forming process because spring-back and residual stresses are negligible compared with conventional cold forming processes. Finishing process steps, such as trimming, welding, and assembling may be completed as indicated at step 18 in FIG. 1.

Although the present invention has been described with respect to specific embodiments thereof, various changes and modifications can be carried out by those skilled in the art without departing from the scope of the invention. Therefore, it is intended that the present invention encompass such changes and modifications as fall within the scope of the appended claims.

I claim:

1. A method of superplastic forming of metals, comprising the steps of:

providing a billet of metal having a uniform, equiaxed, ultra-fine grain microstructure with grain dimensions less than about 10 μm;

controlling temperature and strain rate of said billet to maintain said metal within a superplastic regime of temperature and strain rate;

forcing said billet of metal through an extrusion die while maintaining said metal within said superplastic regime of temperature and strain rate;

extruding from said extrusion die a complex-shaped extruded metal component; and creep-age forming said complex-shaped metal component extruded from said extrusion die.

2. The method of claim 1, wherein the forcing step comprises forcing said billet through a temperature controlled extrusion die for maintaining said billet within said superplastic temperature regime.

3. The method of claim 2, wherein the forcing step further comprises forcing said billet through a thermostatically controlled isothermal extrusion die.

4. The method of claim 1, wherein the controlling step further comprises controlling an extrusion ram speed for maintaining said billet within said superplastic strain rate regime.

5. The method of claim 1, wherein the step of providing said billet includes the step of selecting the metal from the group of superplastically formable metals consisting of aluminum alloys; titanium alloys; nickel, cobalt, and iron-based superalloys; stainless steels; carbon steels; copper alloys; and magnesium alloys.

6. The method of claim 1, wherein the step of providing said billet further includes the step of performing equal channel angular extrusion of said billet for producing said uniform, equiaxed, ultra-fine grain microstructure.

7. A method of superplastic forming of metals, comprising the steps of:

providing a billet of metal selected from the group of superplastically formable metals consisting of aluminum alloys; titanium alloys; nickel, cobalt, and iron-based superalloys; stainless steels; carbon steels; copper alloys; and magnesium alloys;

performing equal channel angular extrusion of said billet to form an extrusion billet of said metal having a uniform, equiaxed, ultra-fine grain microstructure with grain dimensions less than about 10 μm;

controlling temperature and strain rate of said extrusion billet to maintain said metal within a superplastic regime of said metal;

forcing said extrusion billet of metal through a temperature controlled extrusion die while maintaining said metal within said superplastic regime of temperature and strain rate;

extruding from said extrusion die a complex-shaped extruded metal component; and creep-age forming said complex-shaped metal component extruded from said extrusion die.

8. The method of claim 7, wherein the forcing step further comprises forcing said extrusion billet through a thermostatically heated isothermal extrusion die for maintaining said extrusion billet within said superplastic temperature regime.

9. The method of claim 7, wherein the step of controlling said strain rate comprises controlling an extrusion ram speed for maintaining said extrusion billet within said superplastic strain rate regime.

10. The method of claim 9, wherein the step of controlling said strain rate comprises controlling said strain rate at fastest straining locations of said extrusion die.

11. The method of claim 7, wherein the extruding step further comprises extruding said complex-shaped metal component in a shape selected from the components consisting of thin cross section panels, I-beams, integrally stiffened panels, and hollow section components.

12. The method of claim 11, wherein the extruding step further comprises extruding said complex-shaped metal component in a shape selected from the components consisting of T-stiffened panels and closed-box panels.

13. A method of superplastic extrusion of metals, comprising the steps of:

providing a billet of metal selected from the group of superplastically formable metals consisting of aluminum alloys; titanium alloys; nickel, cobalt, and iron-based superalloys; stainless steels; carbon steels; copper alloys; and magnesium alloys;

performing equal channel angular extrusion of said billet to form an extrusion billet of metal having a uniform, equiaxed, ultra-fine grain microstructure with grain dimensions less than about 10 μm;

controlling temperature and strain rate of said extrusion billet to maintain said metal within a superplastic regime of said metal;

forcing said extrusion billet of metal through a thermostatically heated isothermal extrusion die while maintaining said metal within said superplastic regime of temperature and strain rate;

extruding from said extrusion die a complex-shaped extruded metal component having a shape selected from the components consisting of I-beams, thin cross section panels, integrally stiffened panels, T-stiffened panels, closed-box panels, and hollow section components; and creep-age forming said complex-shaped metal component extruded from said extrusion die.

14. The method of claim 13, wherein the step of extruding comprises extruding said complex-shaped metal component from a multi-hole extrusion die.

* * * * *